United States Patent [19]

Laviola

[11] 4,218,947

[45] Aug. 26, 1980

[54] MITRE BOX

[76] Inventor: Joseph Laviola, 1859 Bellemore Ave., Deptford, N.J. 08096

[21] Appl. No.: 23,155

[22] Filed: Mar. 23, 1979

[51] Int. Cl.[2] ..... B27G 5/02

[52] U.S. Cl. ..... 83/762; 83/455; 83/581; 145/129

[58] Field of Search ..... 83/762, 763, 761, 455, 83/581, 821, 827, 454; 145/129

[56] References Cited

U.S. PATENT DOCUMENTS

| | | | |
|---|---|---|---|
| 345,590 | 7/1886 | Hinze | 83/762 |
| 376,192 | 1/1888 | Googins | 83/765 |
| 957,871 | 5/1910 | Dunne | 83/763 |
| 976,097 | 11/1910 | Peterson | 83/763 |
| 3,709,266 | 1/1973 | Fusco | 83/761 |

*Primary Examiner*—Donald R. Schran

*Attorney, Agent, or Firm*—Duffield & Lehrer

[57] ABSTRACT

A mitre box particularly adapted for precise mitring of inside and outside corner molding includes a square base having a first saw guide mounted on the upper surface thereof along a diagonal of the base. A second saw guide is also mounted on the base and is comprised of a pair of blocks located adjacent two edges of the square; the pair of blocks terminating adjacent a corner on the diagonal in line with the first guide. A rectangularly shaped support block is mounted on the base on either side of each of the guide blocks for supporting the molding to be mitred in proper orientation. The lower portions of the ends of the guide blocks adjacent the corner are cut away to allow the end of the molding being mitred to pass therethrough.

5 Claims, 5 Drawing Figures

MITRE BOX

BACKGROUND OF THE INVENTION

The present invention is directed toward a miter box and more particularly toward a miter box which is specifically designed for the precise mitring of inside and outside corner molding.

Molding and trim and the like have been in use in the construction business for many years. It is primarily used for decorative reasons and is placed in corners where two walls meet or where a wall and ceiling meet or in other similar locations.

It is also well-known that when two pieces of molding meet at a corner, the ends thereof must be cut in such a way that the pieces fit together to form a corner. Normally the corner formed is a right angle or 90° corner. The cutting of the ends of the molding so as to properly fit together is referred to as mitring.

Mitring is conventionally performed in a device known as miter box. The most common miter box in use is comprised of a base and two parallel side walls extending upwardly therefrom. A saw cut or groove is made in the side walls downwardly from the top thereof toward the base at an angle of 45° from the axis of the base. A saw is then placed in the groove and anything placed on the base of the miter box and parallel to one of the side walls will be cut at an angle of 45°. It should be readily apparent that in order for two members to fit together at a right angle, each of them must be cut at a 45° angle.

The conventional miter box described above is somewhat useful with relatively large items which are being mitered. However, it is extremely difficult and in many cases impossible to precision miter the average corner moldings with such conventional miter boxes. This is primarily due to the fact that there are no means provided for accurately positioning the molding while it is being mitered. The difficulty becomes even greater when the end of the molding must be mitered in more than one manner so as to mate with two other moldings. This frequently occurs, for example, at the junction between two walls and a ceiling. Conventional miter boxes also make it difficult to hold the molding while it is being mitered. All of the foregoing problems and deficiencies of prior miter boxes are well-known to those who have attempted to utilize the same.

SUMMARY OF THE INVENTION

To applicant's knowledge, there has never been designed a miter box which is particularly adapted for the precise cutting of inside and outside corner moldings. The present invention provides such a device and includes a square base having a first saw guide mounted on the upper surface thereof along a diagonal of the base. A second saw guide is also mounted on the base and is comprised of a pair of blocks located adjacent two edges of the square; the pair of blocks terminating adjacent a corner on the diagonal in line with the first guide. A rectangularly shaped support block is mounted on the base on either side of each of the guide blocks for supporting the molding to be mitered in proper orientation. The lower portions of the ends of the guide blocks adjacent the corner are cut away to allow the end of the molding being mitered to pass therethrough.

BRIEF DESCRIPTION OF THE DRAWINGS

For the purpose of illustrating the invention, there is shown in the accompanying drawings one form which is presently preferred; it being understood that the invention is not intended to be limited to the precise arrangements and instrumentalities shown.

DETAILED DESCRIPTION OF THE PREFERRED EMBODIMENT

Figure 1:
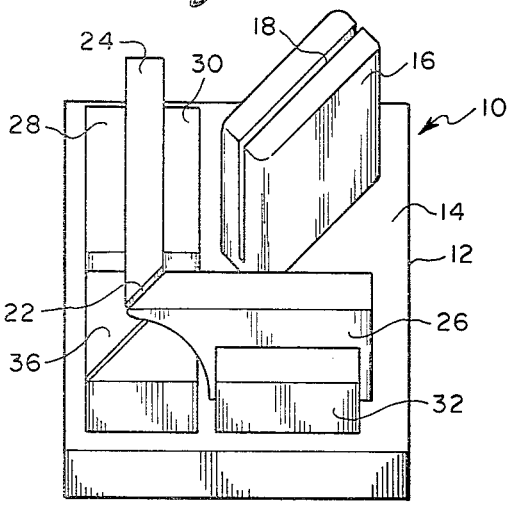
FIG. 1 is a right side perspective view of a miter box constructed in accordance with the principles of the present invention.

Referring now to the drawings in detail wherein like reference numerals have been used throughout the various figures to designate like elements, there is shown in FIG. 1 a miter box constructed in accordance with the principles of the present invention and designated generally as 10.

Figure 2:
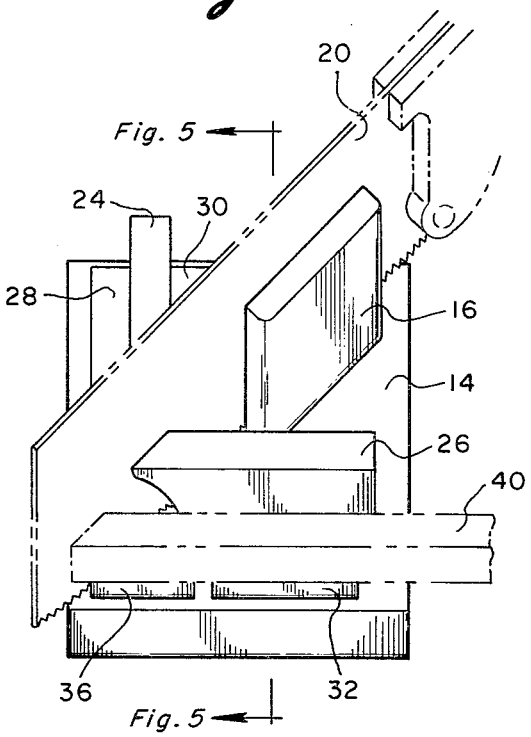
FIG. 2 is a view similar to FIG. 1 but showing the miter box in use.

Miter box 10 is comprised of a substantially rectangular and preferably square base member 12 having a substantially flat upper surface 14. Mounted on the upper surface 14 of base 12 and in line with one of the diagonals of the square is a first saw guide 16. Saw guide 16 extends upwardly from the base 12 and includes a groove 18 therethrough which is in alignment with the diagonal of the base 12 along which the saw guide 16 is arranged. As shown best in FIG. 2, the first saw guide 16 and particularly the groove 18 is adapted to guide a saw blade 20 along the same diagonal of the base 12.

Figure 3:
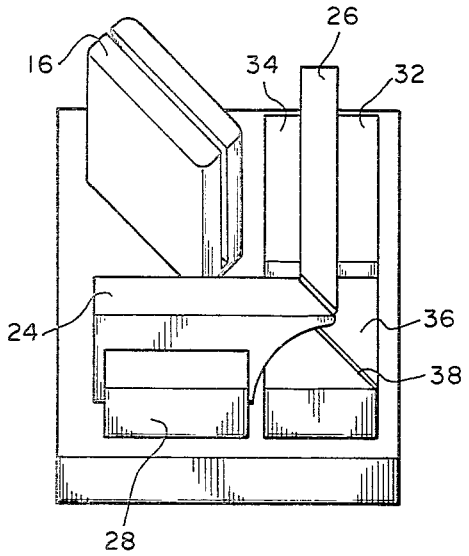
FIG. 3 is a view similar to FIG. 1 but from the left side thereof.
Figure 5:
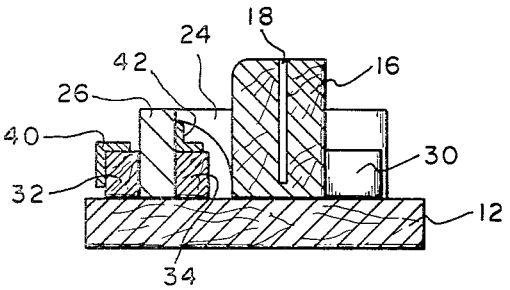
FIG. 5 is a cross sectional view taken through the line 5—5 of FIG. 2.

Adjacent the forward end of the miter box 10 is located a second saw guide 22. Second saw guide 22 is comprised of first and second blocks 24 and 26 which are arranged so that each is adjacent and parallel to one edge of the base 12. The blocks 24 and 26 meet at the diagonal in line with the groove 18 in the first saw guide 16 and a small gap remains between blocks 24 and 26 which functions as the second saw guide 22. For the reasons which will become clear hereinafter, each of the blocks 24 and 26 are cut away along the lower portions thereof adjacent the corner where they meet. Thus, second saw guide 22 is positioned above the upper surface 14 of the base member 12 and an opening remains between the second saw guide 22 and the upper surface 14 of the base 12. Located on either side of each of the blocks 24 and 26 is a smaller support block. As shown in FIG. 1, support blocks 28 and 30 are mounted on the surface 14 of base 12 on either side of block 24 and as shown in FIG. 3 support blocks 32 and 34 are positioned on either side of block 26. Each of the support blocks 28, 30, 32 and 34 have substantially flat tops which are substantially parallel to the upper surface 14 of base member 12. In addition, since the side walls of blocks 24 and 26 are substantially vertical, each of the support blocks 28–34 meets its respective guide block 24 or 26 at a substantially right angle as shown best in FIG. 5.

Also mounted on the surface 14 of base member 12 is an additional support block 36. Support block 36 is preferably square in shape with each side being equal in length to the combined widths of blocks 24, 28 and 30 or 26, 32 and 34. As shown in FIGS. 1 and 3, additional support block 36 is located beneath the second saw guide 22 and is in substantial alignment with support blocks 28 and 30 along one edge and with support blocks 32 and 34 along the other. The heights of all of the support blocks 28–36 are substantially identical.

Figure 4:
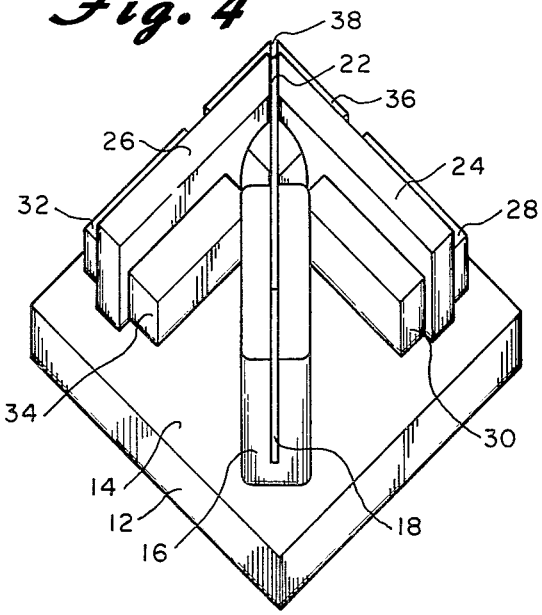
FIG. 4 is a perspective view of the device shown in FIG. 1 but from the rear thereof.

The additional support block 36 also includes a groove 38 formed therein along a diagonal thereof. As shown in FIG. 4, groove 38 is in substantial alignment with the groove 18 in the first saw guide 16 and with the opening in the second saw guide 22. Groove 38 in support block 36 is substantially of the same width as groove 18 so that the saw blade 20 can pass therethrough and be guided thereby.

The miter box 12 of the present invention is used in the following manner. When it is desired to miter an outside corner molding such as molding 40 shown in FIG. 2, the same is placed over the outside corner of support block 32 and support block 36 with the end lying just pass the end of support block 36. The saw blade 20 is then placed in the first and second saw guides 16 and 22 and as the molding 40 is being cut, the lower part of the saw blade enters the groove 38 in support block 36. As should be readily apparent to those skilled in the art, molding 40 could also be cut by placing the same on the outside corners of support blocks 28, 30 or 34, depending on the particular cut desired. Similarly, inside corner molding such as shown at 42 in FIG. 5 can be placed in any of the four inside corners i.e. the corners between the blocks 24 and support block 28 or 30 or between the block 26 and the support block 32 or 34. As should also be readily apparent to those skilled in the art, one of the main advantages of the present invention is that the numerous corners of the various blocks 24–36 can be used to simulate the actual corners for which the molding is to be applied thereby leaving the guesswork out of which way to cut or miter the molding. In addition, because of the arrangement of the blocks of the present invention, the molding being cut can be easily held in place with one hand.

In the preferred embodiment of the invention shown in the drawings, all of the elements of the miter box 10 are shown to be made of wood. This, however, is by way of example only and it should be readily apparent that numerous other materials could also be used in the manufacture of the miter box.

The present invention may be embodied in other specific forms without departing from the spirit or essential attributes thereof and, accordingly, reference should be made to the appended claims, rather than to the foregoing specification as indicating the scope of the invention.

I claim:

1. A miter box comprising:

a substantially flat and rectangularly shaped base member;

a first saw guide mounted on the upper surface of said base member along a diagonal thereof, said first saw guide being adapted to guide a saw along said diagonal;

a second saw guide spaced from said first saw guide but being in alignment therewith along said diagonal, said second saw guide being positioned above the upper surface of said base member, an opening remaining beneath said second saw guide and between the same and said base member for allowing the material being mitered to pass therethrough, and means adjacent at least one edge of said base for supporting said material being mitered.

2. A miter box as claimed in claim 1 wherein said base member is substantially square.

3. A miter box as claimed in claim 2 further including means adjacent a second edge of said base for supporting said material being mitered, said second edge being perpendicular to said first edge.

4. A miter box as claimed in claim 3 wherein said second saw guide is formed by a pair of elongated blocks mounted on said base member, each block being mounted adjacent one of said edges, a gap remaining between the ends of said blocks.

5. A miter box as claimed in claim 4 wherein said support means includes a support block mounted on said base member on each side of each of said blocks forming said second saw guide.

* * * * *